United States Patent [19]

Majka

[11] 4,126,247

[45] Nov. 21, 1978

[54] PILL DISPENSER

[76] Inventor: Anthony Majka, 28 S. Marion Pl., Rockville Centre, N.Y. 11570

[21] Appl. No.: 842,084

[22] Filed: Oct. 14, 1977

[51] Int. Cl.[2] ..... G07F 11/00

[52] U.S. Cl. ..... 221/2; 221/91

[58] Field of Search ..... 221/82, 86, 72, 2, 154, 221/155, 89, 91; 206/534, 538; 116/121

[56] References Cited

U.S. PATENT DOCUMENTS

| | | | |
|---|---|---|---|
| 1,869,070 | 7/1932 | McLaren | 221/89 |
| 3,393,794 | 7/1968 | Borin | 221/91 X |
| 4,039,080 | 8/1977 | Cappuccilli | 116/121 X |

*Primary Examiner*—Allen N. Knowles
*Attorney, Agent, or Firm*—Daniel Jay Tick

[57] ABSTRACT

An upright housing has a transparent side. A plurality of compartments are positioned in rows and columns in upright arrangement in the housing next-adjacent the transparent side. Each column represents a day of the week and each row represents a week of a month. Each compartment is adapted to store a day's medication. A calendar marking indication on the transparent side of the housing labels each compartment as a different day of the month. An opening is formed through the bottom of the transparent side of the housing. A chute device in the housing extends in common from each of the compartments to the opening. A key-operated control device maintains medication in each compartment and releases medication from a selection compartment to the opening upon operation.

2 Claims, 5 Drawing Figures

PILL DISPENSER

BACKGROUND OF THE INVENTION

The present invention relates to a pill dispenser. More particularly, the invention relates to a pill dispenser for dispensing daily medication, prestored for a month.

Objects of the invention are to provide a pill dispenser of simple structure, which is inexpensive in manufacture, used with facility and convenience, and functions efficiently, effectively and reliably to dispense daily medication on a completely secure basis whereby only a person having a key may dispense such medication, whereby the medication is inaccessible to children and confused people.

BRIEF DESCRIPTION OF THE DRAWINGS

In order that the invention may be readily carried into effect, it will now be described with reference to the accompanying drawings, wherein.

DETAILED DESCRIPTION OF THE INVENTION

The pill dispenser of the invention dispenses daily medication, prestored for a month. The medication is dispensed with considerable security since it is available only by key-operated control. It is thus not available to children or unauthorized people.

Figure 1:
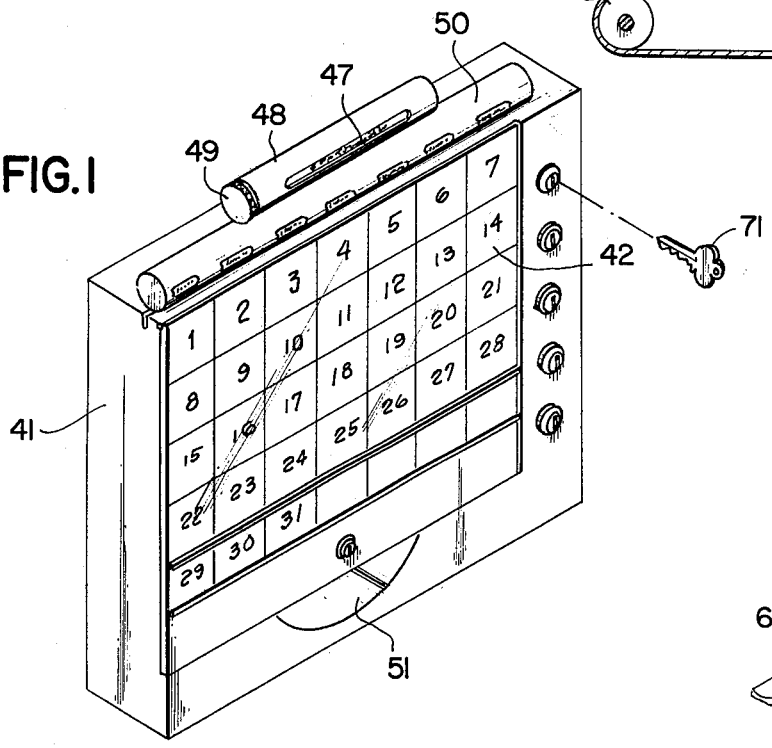
FIG. 1 is a perspective view of an embodiment of the pill dispenser of the invention.
Figure 2:
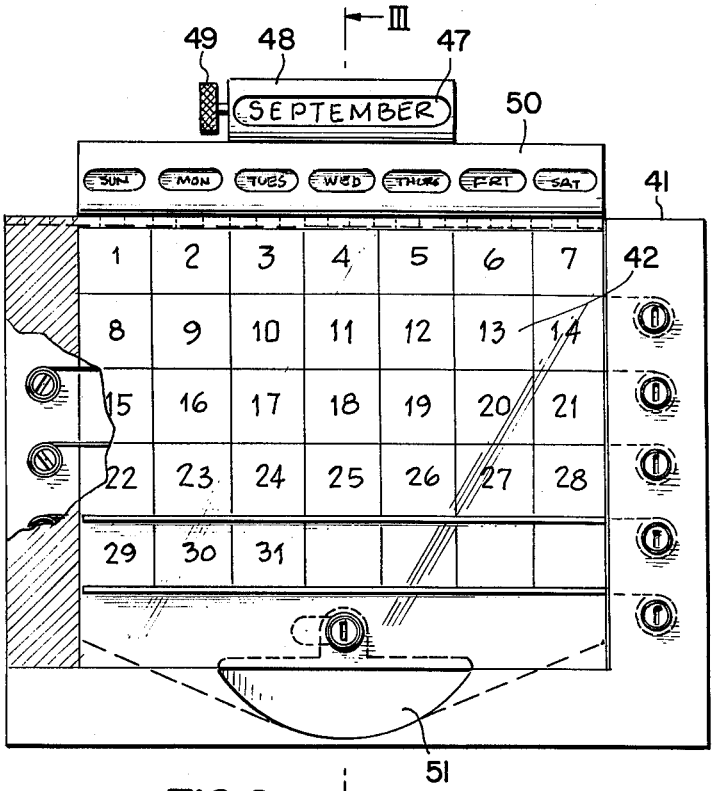
FIG. 2 is a front view, on an enlarged scale, partly cutaway, and partly in section, of the embodiment of FIG. 1.
Figure 3:
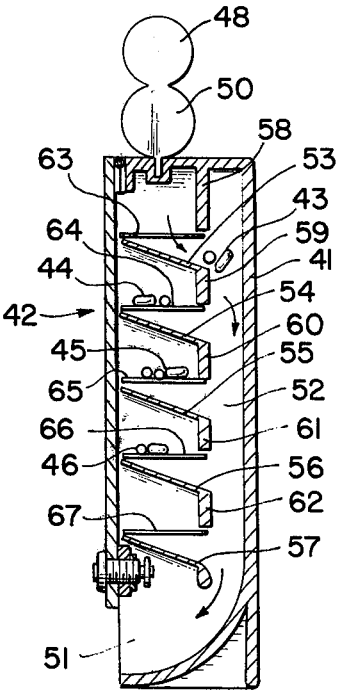
FIG. 3 is a cross-sectional view, taken along the lines III—III of FIG. 2.

The pill dispenser of the invention comprises an upright housing 41 having a transparent side 42 (FIGS. 1 to 3).

A plurality of compartments are positioned in rows and columns in upright arrangement in the housing 41 next-adjacent the transparent side 42. Each column corresponds a day of the week and each row corresponds a week of a month. Thus, the column on the farthest left represents Sundays. The next-adjacent column to the right represents Mondays, and so on. The uppermost row represents the first week of the month. Each compartment is adapted to store a day's medication 43, 44, 45, 46, and so on (FIG. 3).

A calendar marking device on the transparent side 42 of the housing 41 labels each compartment, as shown in FIGS. 1 and 2, as a different day of the month. An adjustable roller 47 (FIGS. 1 and 2) has the months of the year printed on it and is rotatably mounted in a housing 48 with an open window, mounted atop the housing 41. Thus, the user sets the proper month via a knurled knob 49 (FIGS. 1 and 2). A housing 50 (FIGS. 1 to 3) interposed between the housing 48 and the housing 41, indicates the days of the week. The user places a transparency over the transparent side 42 of the housing 41 with the days of the month arranged in their proper order with the first day of the month beginning on the proper day and the last day of the month coinciding with the proper day.

An opening 51 (FIGS. 1 to 3) is formed through the bottom of the transparent side 42 of the housing 41.

A chute device 52 (FIG. 3) extends in common from each of the compartments to the opening 51.

Each of the compartments has a bottom 53, 54, 55, 56, 57, and so on (FIG. 3), which slopes downward from the transparent side 42 of the housing and a back 58, 59, 60, 61 and 62, respectively, spaced from the bottom 53 to 57, respectively, as shown in FIG. 3, in a manner whereby medication on the bottom, as illustrated in FIG. 3 for the medication 43, rolls into the chute device 52.

Figure 4:
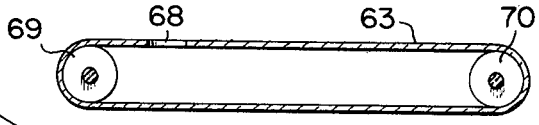
FIG. 4 is a side view, partly in section, of an embodiment of the control means of the pill dispenser of the invention.
Figure 5:
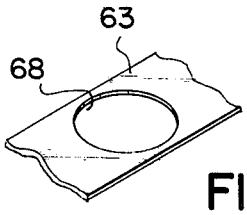
FIG. 5 is a perspective view, on an enlarged scale, of part of the embodiment of FIG. 4.

In accordance with the invention, a key-operated control device maintains medication in each compartment and releases medication from a selected compartment to the opening 51 upon operation of the control device. The control device comprises a strip of material 63, 64, 65, 66 and 67 (FIG. 3), each mounted in a row and extending substantially perpendicularly from the transparent side 42 of the housing 41 through each compartment of a row to the back of each compartment and spaced above the bottom of each compartment. FIGS. 4 and 5 show the strip of material 63 in more detail. The material of the strip may comprise any suitable material such as, for example, plastic of the type used in movie film, or the like. As shown in FIG. 3, the strip of material 63 extends substantially perpendicularly from the transparent side 42 of the housing through the compartments of the uppermost row to the back 58 of such compartments and is spaced above the bottom 53 of such compartments. The strip of material 64 extends substantially perpendicularly from the transparent side 42 of the housing through the compartments of the next lower row to the back 59 of such compartments and is spaced above the bottom 54 of such compartments. The strip of material 65 extends substantially perpendicularly from the transparent side 42 of the housing through the compartments of the third row from the top to the back 60 of such compartments and is spaced above the bottom 55 of such compartments. The strip of material 66 extends substantially perpendicularly from the transparent side 42 of the housing through the compartments of the second row from the bottom row to the back 61 of such compartments and is spaced above the bottom 56 of such compartments. The strip of material 67 extends substantially perpendicularly from the transparent side 42 of the housing through the compartments of the bottom row to the back 62 of such compartments and is spaced above the bottom 57 of such compartments.

The strip of material in each row supports medication in each compartment in that row, and has a hole formed therethrough.

In each of FIGS. 4 and 5, the hole 68 through the strip of material 63 is shown. Furthermore, the strip of material in each row is movable in directions along the row under the control of a key to position the hole in a selected compartment whereby medication in such compartment falls through the hole to the bottom of the compartment and then to the opening 51 via the chute device 52. FIG. 4 shows the strip of material 63 for the uppermost row of compartments mounted on a pair of rollers 69 and 70. The roller 70 is rotated under the control of a key 71, shown in FIG. 1, to position the hole 68 in a selected compartment 1, 2, 3, 4, 5, 6, 7, sequentially, whereby medication in the compartment in which the hole appears falls through the hole to the bottom 53 of the compartment and then to the opening 51 via the chute 52. In order to function fully automatically, the strips of material 63 to 67 are preferably endless strips mounted on rollers with the bottom of the row of compartments positioned above the return or lower part of the strip to prevent interference of said strip with medication which has fallen through the hole.

While the invention has been described by means of a specific example and in a specific embodiment, I do not wish to be limited thereto, for obvious modifications will occur to those skilled in the art without departing from the spirit and scope of the invention.

Pill dispensers of the type described in the present application are disclosed in the following U.S. Pat. Nos.: 3,397,671, issued to Hartman Jr., et al on Aug. 20, 1968, 3,450,306, issued to Gill on June 17, 1969, 3,584,598, issued to Gayle et al on June 15, 1971, 3,587,517, issued to Fites et al on June 28, 1971, 3,630,171, issued to Huck on Dec. 28, 1971 and 3,921,806, issued to Wawracz on Nov. 25, 1975.

I claim:

1. A pill dispenser for dispensing daily medication, prestored for a month, said pill dispenser comprising an upright housing having a transparent side;

a plurality of compartments positioned in rows and columns in upright arrangement in the housing, next-adjacent the transparent side, each column representing a day of the week and each row representing a week of a month, each compartment being adapted to store a day's medication;

calendar marking means in the transparent side of the housing labelling each compartment as a different day of the month;

an opening formed through the bottom of the transparent side of the housing;

chute means in the housing extending in common from each of the compartments to the opening; and key-operated control means for maintaining medication in each compartment and releasing medication from a selected compartment to the opening upon operation.

2. A pill dispenser as claimed in claim 1, wherein each of the compartments has a bottom sloping downward from the transparent side of the housing and a back spaced from the bottom in a manner whereby medication on the bottom rolls into the chute means, and the control means comprises a strip of material movably mounted in a row and extending substantially perpendicularly form the transparent side of the housing through each compartment of a row to the back of each compartment and spaced above the bottom of each compartment, said strip of material supporting medication in each compartment in a row and having a hole formed therethrough and being movable in directions along the row under the control of a key to position the hole in a selected compartment whereby medication in such compartment falls through the hole to the bottom of the compartment and then to the opening via the chute means.

* * * * *